United States Patent [19]

Maibauer

[11] Patent Number: 4,791,685

[45] Date of Patent: Dec. 20, 1988

[54] VENTILATED PROTECTIVE GARMENT

[76] Inventor: Frederick P. Maibauer, 5600 Paint Valley, Rochester, Mich. 48064

[21] Appl. No.: 29,976

[22] Filed: Mar. 25, 1987

[51] Int. Cl.[4] ..... A41D 1/06

[52] U.S. Cl. ..... 2/227; 2/46; 2/79; 2/DIG. 1

[58] Field of Search ..... 2/227, 79, DIG. 1, 46, 2/272, 78

[56] References Cited

U.S. PATENT DOCUMENTS

| | | | |
|---|---|---|---|
| 1,571,016 | 1/1926 | Lesser | 2/227 |
| 2,391,535 | 12/1945 | Zelano | 2/DIG. 1 |
| 3,153,793 | 10/1964 | Lepone | 2/DIG. 1 |
| 3,397,407 | 8/1968 | Gallagher | 2/DIG. 1 |
| 3,637,230 | 1/1972 | Poik | 2/227 |
| 3,703,432 | 11/1972 | Koski | 2/87 X |
| 3,761,962 | 10/1973 | Myers | 2/DIG. 1 |
| 3,780,380 | 12/1973 | Lafollette | 2/78 R |
| 4,185,327 | 1/1980 | Markve | 2/79 X |
| 4,282,608 | 8/1981 | Amberg | 2/227 |

FOREIGN PATENT DOCUMENTS

| | | |
|---|---|---|
| 2437804 | 6/1980 | France . |
| 540546 | 10/1941 | United Kingdom . |

*Primary Examiner*—H. Hampton Hunter

[57] ABSTRACT

A garment made of plastic film of the type and thickness often used for the manufacture of grocery sacks and garbage bags is disclosed. Stretch and ventilation of the garment is provided in spite of the relative inelasticity and impervious nature of plastic film by cutting a plurality of small slits in parallel rows, the slits being staggered in one row with respect to the slits in adjacent rows. In this way the plastic material is allowed to deform into a plurality of diamond shaped openings which at one and the same time provide both flexibility and ventilation to a plastic garment. The rows of slits are confined, in one embodiment, to the inseams and abdominal areas of the garment. This configuration leaves the knee, frontal thigh, and seat areas impervious to water and thus protect the wearer at those areas in which the outer garments are most likely to become wet, while at the same time providing both ventilation and stretch in the groin and abdominal areas to allow the garment to conform itself to the shape of the wearers anatomy and keep the wearer comfortable. In another embodiment, slits are also provided in the outer leg seam area to give even more stretch capacity and increase the size coverage of the garment.

11 Claims, 2 Drawing Sheets

VENTILATED PROTECTIVE GARMENT

FIELD OF THE INVENTION

The present invention relates to ventilated garments for protecting those engaged in work or sporting activities in a snow environment. More particularly, the invention provides a ventilated yet disposable garment suitable for dispensing by unattended vending machines and used as a liner under outer clothing to keep the wearer dry and comfortable.

BACKGROUND OF THE INVENTION

When engaged in winter sports or when working in a snow environment, ones outer clothing often becomes wet from melting snow. This wetness soaks through to under garments which results in discomfort and possible excessive body heat loss. Melted snow may be contacted by sitting on equipment seats, and ski chair lift seats, as well as by falling into the snow. The melted snow soaks through outer garments, particularly in the seat area of pants. Wearing waterproof outer garments is often not an effective solution because such garments are not stylish in appearance. Furthermore, waterproof outer garments do not permit the free flow of air for body ventilation, surface wear renders them non waterproof, and they usually have a slippery surface which is unsafe.

Makeshift garments fashioned from plastic sacks are known and used as rain wear or over shoes for a limited time and then discarded.

French Pat. No. 2437804 teaches that plastic bags may be initially manufactured with tear lines to facilitate secondary usage by recycling as an article of clothing. Specifically this patent teaches that plastic shopping bags be used as baby pants or waterproof trousers. Two problems are apparent when one considers such secondary usage of plastic bags. The first problem is that the bags, in order to be cheap and strong are made to be relatively inelastic and resistant to stretch. Thus the garment, so made tends to bind and pinch in the crotch and at the upper thighs as the garment is forced outward in the abdominal area or at the seat of pants. The second problem is that such plastic clothing is impervious to water vapor as well as to water itself. Often the wearer gets wet from condensate which accumulates inside of the garment with out even coming into contact with wet surfaces.

It is also known in the prior art to form plastic material into the shape of pants for winter sports use such as sliding on snow. Forming the garment into the proper shape not only is expensive but then requires that a large number of garments of varying sizes by kept available in order to adequately serve the consuming public at for example, a ski resort. This reference also does not solve the problem of condensation.

The prior art also teaches reinforcing the groin area of a temporarily worn garment which serves to keep clothing being tried on for size at stores from becoming soiled from contact with the under clothing of a customer. That garments, which are only worn for a short time while outer garments are being tried on for fit and style, requires reinforcing underscores the seriousness of the problem of inelasticity in plastic garments.

Rain coats are subject to fewer localized stretching areas and so can be manufactured in a roll having a plurality of end to end garments which are torn off, one at a time.

Ventilated plastic materials have been proposed in the art but it is more expensive to manufacture than single impervious sheets and therefore are not cost competitive in the market of disposable garments. Use of such materials are not known to have been practiced commercially.

The prior art also contains a variety of teachings in the areas of ventilated pants. None of the known teachings can be considered to be simple enough to cheaply manufacture for dispensing as disposable wear. Furthermore, they do not consider the problems of water soaking through to the under clothing of the wearer nor are they of variable size.

SUMMARY OF THE INVENTION

It is an advantageous effect of the present invention to provide a comfortable, and variable size garment that will be easy and inexpensive to manufacture and that will protect the wearer in an environment of melting snow and ice.

It is a further advantageous effect of the present invention that the garment is ventilated without substantially reducing its protective qualities and therefore has substantially overcome the problem of condensation.

The present invention yields the still further advantage of synergistically combining the ventilating and stretch generating properties in a way that permits comfortable protective garments to be made from single thickness plastic sheet material which are cheap enough so as to be disposable and also easily dispensed from rolls.

These and other advantages which will become apparent to the reader from the following specification of a preferred embodiment when read with reference to the drawings are accomplished by providing a plurality of parallel rows of small slits, the slits being staggered in one row with respect to the slits in adjacent rows. In this way the plastic material is allowed to deform into a plurality of diamond shaped openings which at one and the same time provide both flexibility and ventilation to a plastic garment. The rows of slits are confined, in one embodiment, to the inseam and abdominal areas of the garment. This configuration leaves the knee, frontal thigh, and seat areas impervious to water and thus protect the wearer at those areas in which the outer garments are most likely to become wet, while at the same time providing both ventilation and stretch in the groin and abdominal areas to allow the garment to conform itself to the shape of the wearers anatomy and keep the wearer comfortable. In another embodiment, slits are also provided in the outer leg seam area to give even more stretch capacity and increase the size coverage of the garment.

A PREFERRED EMBODIMENT OF THE INVENTION

Figure 1:
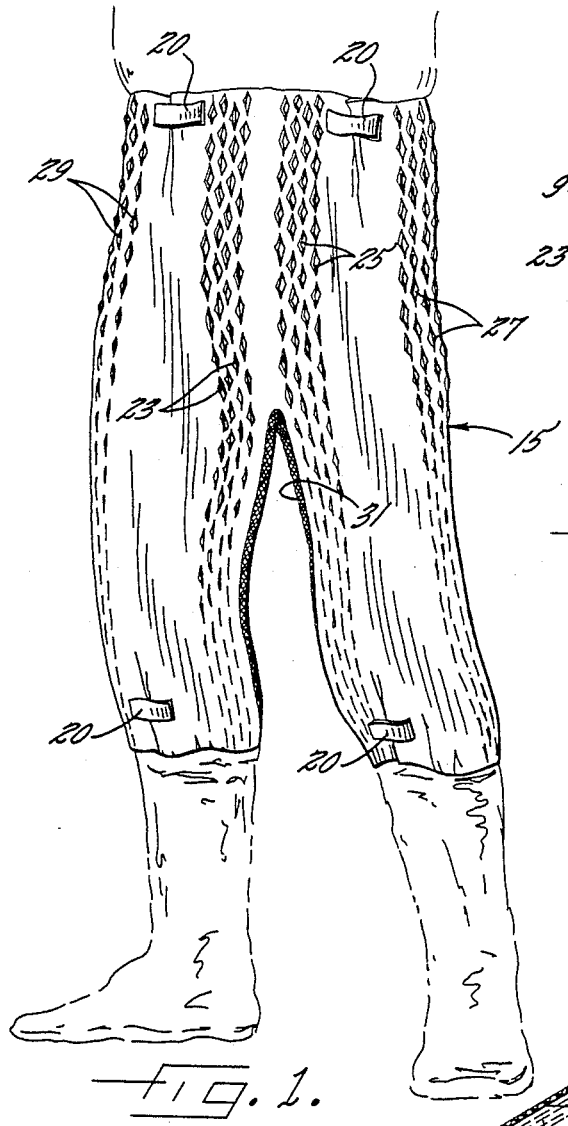
FIG. 1 is a perspective view of the garment of the present invention being shown on a wearer who has not yet donned outer clothing.
Figure 4:
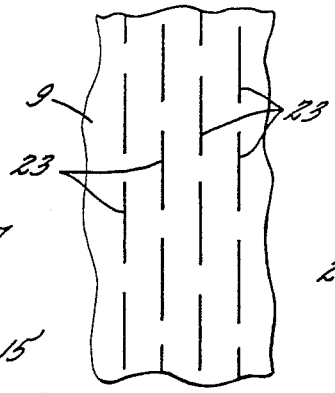
FIG. 4 shows an enlarged view of a typical pattern of slits
Figure 5:
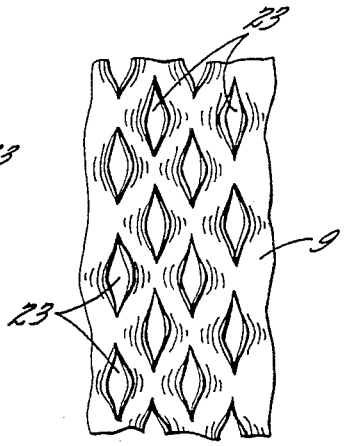
FIG. 5 shows an enlarged view of the slits of FIG. 4 after they have been expanded.
Figure 2:
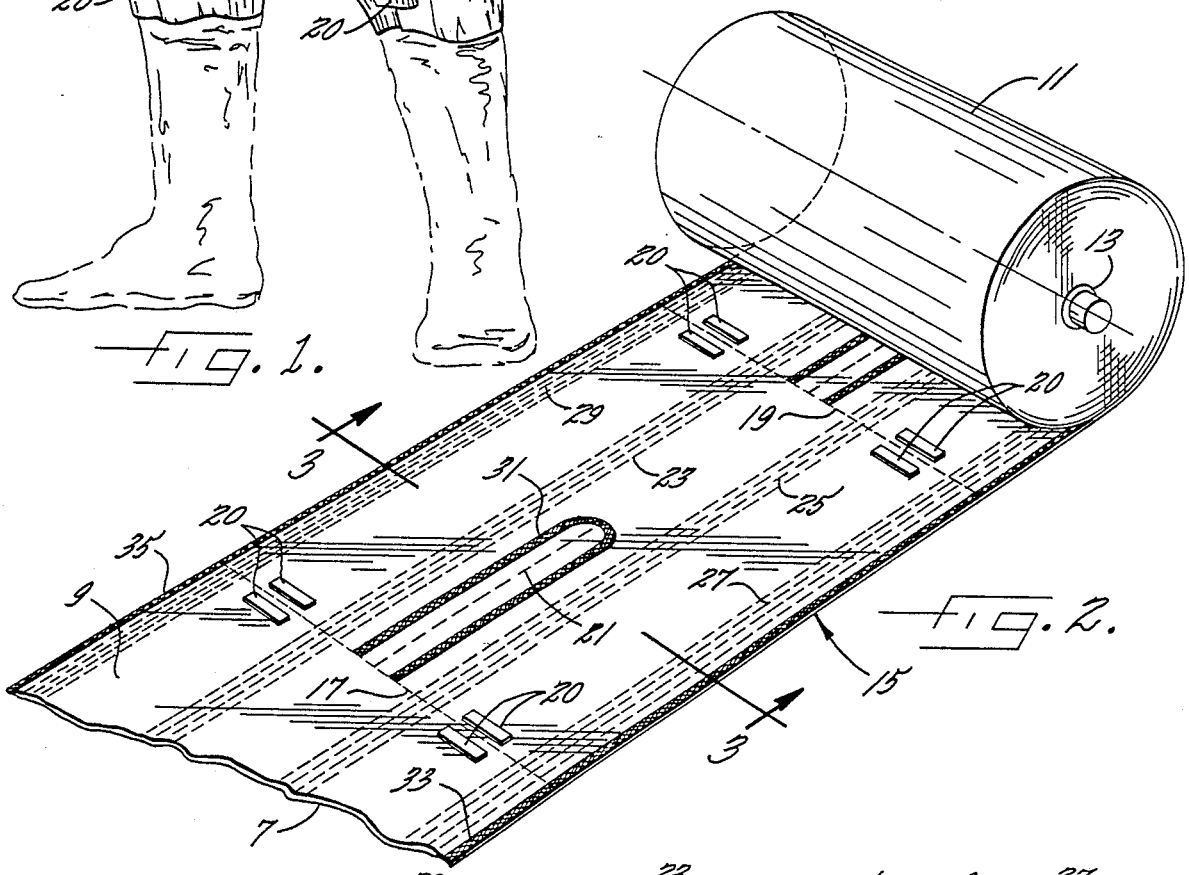
FIG. 2 shows a perspective view of the garment as it is withdrawn from a roll of garments in preparation the being torn free of the roll.
Figure 6:
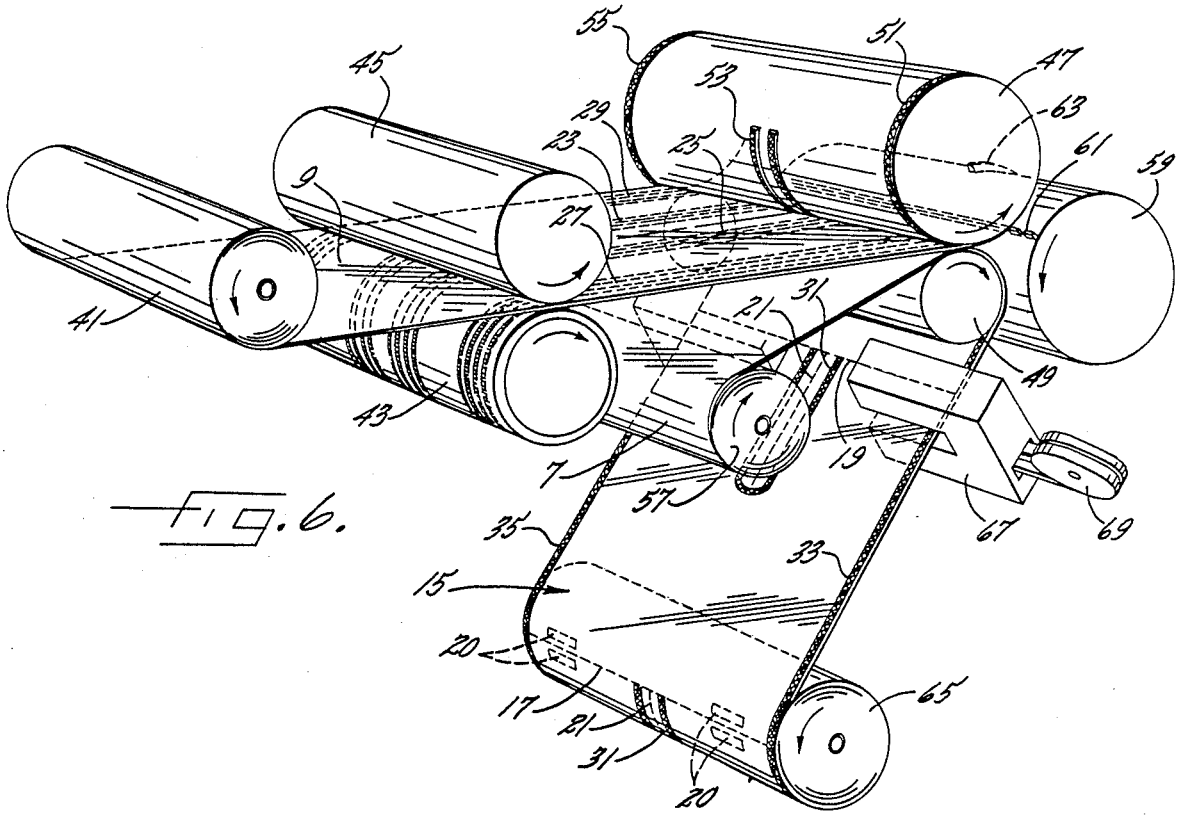
FIG. 6 shows a perspective view of a method of making the garment of FIGS. 1 and 2.
Figure 7:
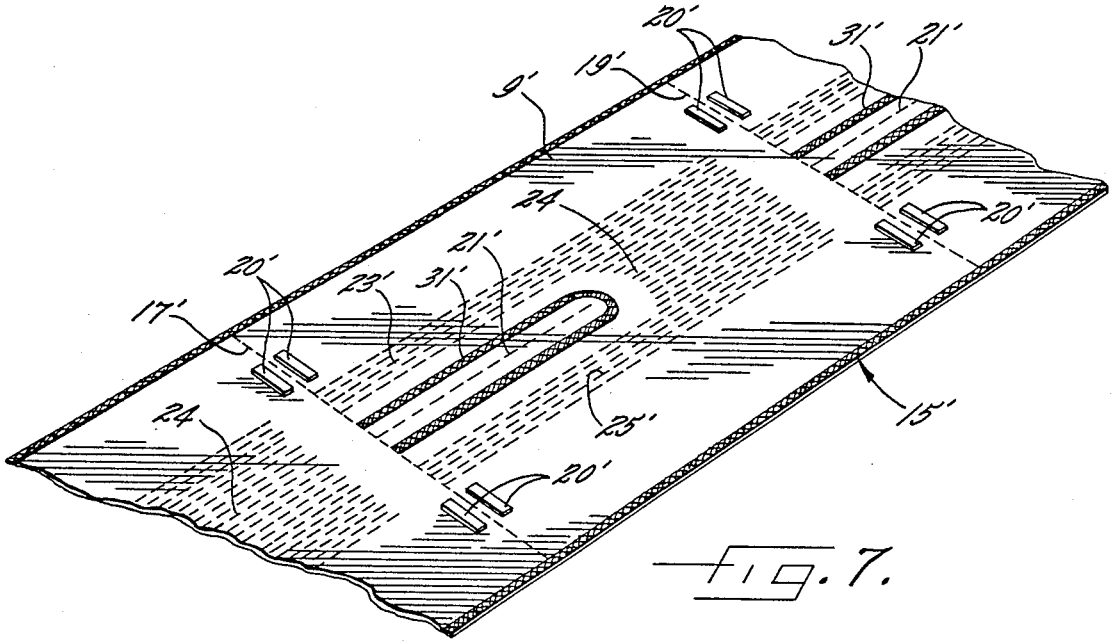
FIG. 7 shows a perspective view of a garment having an alternate placement of the pattern of slits.

With reference to FIGS. 1 through 7, a preferred embodiment of the invention will now be described. In FIG. 2, a roll of garments is shown at 11 having a center spool 13 for supporting the roll as garments are unrolled from the roll 11. A garment 15 is shown ready to be separated from the roll at perforation lines 17 and 19. The roll of garments is made up of two separate sheets of plastic material which have been joined by welds or other means, along their edges at 33 and 35 to provide a tubular form. Prior to being joined, the top layer of plastic is longitudinally cut with several rows of spaced slits as shown in FIG. 4 and alternately as shown in FIG. 7.

As can be seen in FIG. 4, the slits in adjacent rows are staggered with respect to each other. Also each slit, being longer than the spacing from one another in each row, slightly overlaps the next leading and the next trailing slits in adjacent rows. Each slit is spaced from the others adequately so as not to weaken the garment more than necessary. A spacing of $\frac{3}{8}$ inch between slits of length $\frac{7}{8}$ inch in rows spaced $\frac{3}{8}$ inch from each other provides an appropriate proportion in 2 mil plastic polypropylene sheets. This can be the same material of which garbage and other utility bags are made even though such material is not of itself, adequately elastic so as to be able to stretch to accommodate the body of a wearer. The slits of FIGS. 1 and 4, open into the diamond shaped apertures when subjected to transverse stretching forces as shown in FIG. 5, to provide the flexibility and ventilation described in the foregoing summary of the invention.

To facilitate separation of each garment which is in the form of a bifurcated tube, transverse perforated tear lines 17 and 19 are provided through both layers of plastic. The perforations are placed close to one another to substantially weaken the plastic sheets along the tear lines so that they can be easily torn free of the roll 11 at the tear lines. Another tear line 21 is provided to permit separation or bifurcation of the lower portion of the garment into the legs of the garment. Just below tear line 19, tape fastenings 20 can be seen. The tape fastenings 20 are strips of adhesive backed material which have been stuck to the plastic for one half of their length and which have a protective tab of glossy material covering the adhesive of the other one half of their length. After putting on the garment and pulling it into conformance with the body, the wearer removes each protective tab and presses the now sticky tape in place hold in the waist and the cuffs of the garment to fit the wearer in the same way as a disposable diaper is fitted to an infant.

Figure 3:
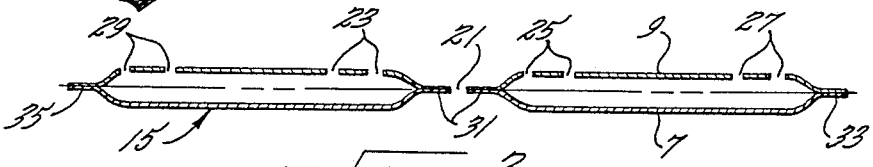
FIG. 3 shows a section view of the garment along section line 3—3.

A secured seam area 31 surrounds perforation line 21 on both sides and the top to provide the inseam of the garment. Likewise, weld lines 33 and 35 provide the outer seams of the garment. Weld lines 33 and 35 can be continuous for the full length of the sheets on the roll but of course the inseam weld 31 can only extend from the perforation line 17 at just below the knee of the garment to the crotch of the garment. These weld lines are also shown in FIG. 3 which is a view of the garment 15 taken along section line 3—3 of FIG. 2. FIG. 3 more clearly shows a bottom layer 7 and a top layer 9 which make up the garment.

Referring again to FIG. 2, several bands 23, 25, 27, and 29 can be seen, each having a plurality of lines or rows of slits. In the preferred embodiment, the slits are made only in the top layer of plastic which becomes the front of the garment when it is being worn. In this way, the ventilating openings appear only towards the front of the wearer. Because of the way in which a persons torso bends when sitting or working, the outer clothing at the frontal portion of one's anatomy is less likely to become wet than the seat and back of one's thighs. If the slits were also provided in the back layer 7, wetness could of course be communicated from wet outer clothing at the seat and outer thighs, through the openings of the slits, to the under clothing and body of the wearer and thus defeat the purpose of the garment. In the embodiment of FIG. 2, the rows of slits extend the entire length of the garment from the knee perforation line 17 to the belt perforation line 19. When extra stretch is desired, additional rows of slits are placed in parallel adjacent to each seam. It is an important part of this invention that the slits of adjacent rows of slits be staggered similar to bricks in a brick wall. In this way, the slits can better open into a series of diamond shaped apertures and keep the plastic sheet material from tearing.

FIGS. 1 and 5 show how the slits of 23, 25, 27 open into a staggered array of diamonds in the abdominal and hip areas where the most stretch is required. In the areas near the knees, less stretch is required during normal body movements and the slits 23, 25, and 27 do not open as widely. It can be noted in FIG. 3 that the line of slits 27 tends to move around the side of the wearer toward the seat area. This deformation is provided for by the abundance of stretch built into the front sheet 9. The back sheet 7 does not stretch because it does not have slits. Slits in the back sheet 7 could reduce this deformation but would have the detrimental effect of admitting moisture from the fabric of the outer garment and therefore are not desirable. The fabric of the outer garment is most likely to become wet at the seat and back of the thighs and therefore the slits are preferably confined to the frontal sheet 9.

FIG. 1 also shows how the tape 20 is used to hold the waist to a dimension that is comfortable to the wearer and does not permit the garment to slide down while it is being worn. Similar tapes are provided at the below knee areas just above tear line 17.

In some environments, it will be found to be desirable to have a greater number of rows of slits adjacent the inseams and to provide no slits at all at the outer seams as shown in FIG. 7. In this way, all stretch and ventilation is confined to the inseam and crotch areas of the garment and the outer seam areas can remain impervious to moisture.

In FIG. 7, a garment 15′ is shown ready to be separated from adjacent garments at perforation lines 17′ and 19′. Just below tear line 19′, tape fastenings 20′ can be seen. The tape fastenings 20′ are the same as fastenings 20 described with respect to FIG. 2. A secured seam area 31′ surrounds perforation line 21′ on both sides and the top to provide the inseam of the garment. Again the garments are made up of two separate sheets of plastic material which have been joined by welds or other means, along their edges at 33′ and 35′ to provide a tubular form. It will be recognized by those skilled in the art of plastic bag manufacture that the tubular form can be obtained by direct extrusion instead of joining two sheets together.

In whatever way the tubular form is created, the top layer of plastic is longitudinally cut with several bands 23' and 25' of spaced slits. The area 24 of the abdomen is also provided with an array of staggered slits. Again, the slits in adjacent rows are staggered with respect to each other and each slit, being longer than the spacing from one another in each row, slightly overlaps the slits in adjacent rows. As will be described hereinafter, the embodiment of FIG. 7 requires that each of the means that cuts the slits remain in synchronism with the means that perforates the tear lines of the garment.

The concentration of the slits at the crotch and abdominal areas as occurs in the embodiment of FIG. 7 will better protect the wearer from getting wet. It is important to note that the wearer is protected both from external moisture and from condensed moisture because by providing the slits which expand into ventilating apertures in the inseam, crotch, and abdominal areas, ventilation is provided at those areas of the wearers body that become the warmest and give off the most perspiration vapors.

The invention as exemplified by the preferred embodiment described above permits garments to be economically manufactured from stock rolls of plastic sheet material by automated equipment. The continuous lines or rows of slits 23, 25, 27, and 29 is a feature of one embodiment which permits the slits to be economically cut with rolling cutter rolls. The cutter rolls have rings of cutter knives mounted in staggered relationship around their circumference as shown in FIG. 6. The front sheet of plastic material 9 is unrolled from supply roll 41 and fed into the nip between cutter roll 43 and platen roll 45. As the front sheet passes between these rolls 43 and 45, the continuous lines of slits 23, 25, 27, and 29 are cut into the sheet 9.

After being cut with the lines of slits, sheet 9 passes into the nip between welding roll 47 and platen roll 49. The back sheet 7 of the garment is unrolled from supply roll 57 and also fed between rolls 47 and 49 as shown in the FIG. 4. Welding roll 47 is chosen to have a circumference equal to the length of the garment being manufactured so that each revolution of roll 47 produces the welds on one garment. Welding roll 47 has at least three welding rings around its circumference. Rings 51 and 55 are continuous heated rings which serve to weld the front sheet 9 to the back sheet 7 as they pass together between rolls 47 and 49. Welding roll 47 also has a segmented welding ring 53 located at the center of the roll for welding the two sheets of plastic together only at the inseams. This center ring is heated only in the area shown as 53 in order to avoid fastening the sheets 7 and 9 together in the abdominal area of the garment.

Continuing to refer to FIG. 6, after the sheets 7 and 9 have been thermally welded together by the heat and pressure of welding roll 47 against platen roll 49, the resulting continuous tube of plastic material is further cut with closely spaced perforations by perforation cutters 61 on roll 59. The cutters 61 cut the perforations 17 and 19 and soforth to permit later separation of the garments from one another. The cutters 61 of roll 59 also bear against platen roll 49. Roll 59 is substantially the same diameter at its cutters as roll 47 is at its welding rings so that the separating perforations for one garment are made at each revolution. Roll 59 is synchronized by gears or other timing means to always be in step with the rotation of roll 47. In this way, the tear off perforations cut by cutters 61 always come at the end of the inseam weld made by weld segment 53 so the the inseams run all the way down to the knees of the garment but the waist line of the garment is not welded together. Another set of perforation cutters, only the single cutter 63 of which can be seen on roll 59 are mounted in a partial ring at the center of roll 59 and operate in synchronism with welding segment 53 to cut the perforations 21 which divide the inseam weld thereby permitting the garments legs to be separated.

After the front layer of plastic 9 has been cut with slits and has been welded onto back layer of plastic 7 to form a tube and then cut with perforations, the thus formed series of garments are rolled up onto roll 65 for easy handling during shipping and later dispensing by vending machines or personnel at ski slopes and the like. While being rolled onto roll 65, the tapes 20 are attached onto the garment using equipment well known in the art and not shown here to avoid unduly complicating the figure. This equipment is of course also synchronized to rolls 47 and 59 so that the tapes can be placed just above and below each transverse tear line 17 to provide the waist and upper calf closures. The tapes have a glossy surfaced backing material covering about half of their length so that one half can stick to the garment and the other half remain unattached until the garment is gathered into place by the wearer who then removes the protective backing and places the tape to hold the gather.

Having described the invention by way of the preferred embodiment, it will be clear to those skilled in the art of plastic article manufacture that various changes can be made in the design and or manufacture of the garment without departing from the spirit and scope of the invention. For example, the tapes 20 can be replaced with a string tie as is often used in bathing suits. Likewise, the outer lines of slits 27, 29 can be made to only occur in the hip area rather than for the full length of the seam. Each of these and other changes which will suggest themselves to the reader are intended to be within the scope of the invention which is to be measured by the following claims.

What is claimed is:

1. A garment for protecting a wearer from moisture comprising:

moisture impervious substantially inelastic plastic in the form of a bifurcated tube of the trousers type having a body portion including a crotch and leg portions, said garment having a plurality of parallel lines of a plurality of slits in an area of said garment were said wearer is least likely to come into contact with wet surfaces in the environment, said area also being an area were substantial stretch is needed, said slits being spaced so as to open into diamond shaped apertures which provide both stretch and ventilation of said garment.

2. The garment of claim 1 wherein said lines of slits are adjacent an inseam of said garment.

3. The garment of claim 2 wherein said lines of slits extend from an area adjacent a knee of said trousers to an area above a crotch of said garment.

4. The garment of claim 3 further comprising: means for fastening a waist portion in a gathered position; and means for fastening cuff portions in gathered positions to hold said trousers in place while being worn.

5. A pants type garment comprising: a first elongated sheet of moisture resistant material including a plurality of longitudinal slits arranged in adjacent rows, said first sheet forming a front area of said garment; a second elongated sheet of moisture resistant material, said second sheet forming a rear area of said garment, said first and second sheets being secured together along portions of their periphery to form said garment with apertures for a wearers legs and torso; said longitudinal slits tending to open under pressure of said wearers body causing said first sheet of said garment to increase in width providing a garment of variable size conforming to dimensions of said wearer, said open slits providing for passage of air to cool said wearer and carry off moisture from interior of said garment while said second sheet provides a barrier to moisture entering said garment from outside said garment.

6. The garment of claim 5 wherein said lines of slits are adjacent an inseam of said pants.

7. The garment of claim 6 wherein said rows of slits are parallel, and said slits open when said pants are being worn to form a band of diamond shaped openings of varying width extending from an area adjacent a knee of said pants to an area above a crotch of said pants.

8. The garment of claim 7 further comprising: means for fastening a waist portion in a gathered position; and means for fastening cuff portions in gathered positions to hold said pants in place while being worn.

9. A pants liner for protecting a wearer from moisture which has soaked outer clothing comprising:

moisture impervious substantially inelastic plastic in the form of a bifurcated tube having body, crotch and leg portions, said pants liner having a plurality of parallel lines each containing a plurality of slits, said lines of slits being adjacent an inseam of said liner, said slits being spaced so as to open into diamond shaped apertures which provide both stretch and ventilation of said liner.

10. The pants liner of claim 9 wherein said lines of slits extend from an area adjacent a knee of said liner to an area above a crotch portion of said liner.

11. The pants liner of claim 10 further comprising:

means for fastening a waist portion in a gathered position; and means for fastening cuff portions in gathered positions to hold said trousers in place while being worn.

* * * * *